US007707663B1

(12) United States Patent
Crawford

(10) Patent No.: US 7,707,663 B1
(45) Date of Patent: May 4, 2010

(54) CUSHION INSERT AND SILICON BOWL ASSEMBLY FOR SHAMPOO BOWL

(76) Inventor: Cristina Crawford, 206 Meadows Dr., Hutto, TX (US) 78634

( * ) Notice: Subject to any disclaimer, the term of this patent is extended or adjusted under 35 U.S.C. 154(b) by 503 days.

(21) Appl. No.: 11/803,616

(22) Filed: May 15, 2007

(51) Int. Cl.
*A45D 44/10* (2006.01)

(52) U.S. Cl. ..... 4/523; 4/580

(58) Field of Classification Search ..... 4/639–641, 4/553, 523, 618, 519, 539, 452, 554, 658, 4/657, DIG. 18, 580
See application file for complete search history.

(56) References Cited

U.S. PATENT DOCUMENTS

| | | | | |
|---|---|---|---|---|
| 4,069,523 | A * | 1/1978 | Ridgeway | 4/580 |
| 4,267,609 | A * | 5/1981 | Altman et al. | 4/580 |
| 4,419,774 | A | 12/1983 | Hajek | |
| 4,763,364 | A | 8/1988 | Morgan | |
| 5,377,365 | A | 1/1995 | Hakim | |
| 5,526,539 | A | 6/1996 | Bower et al. | |
| 5,661,857 | A * | 9/1997 | McLean | 4/657 |
| 5,978,980 | A | 11/1999 | Flora | |
| 6,085,367 | A * | 7/2000 | Guiste | 4/580 |
| 6,230,338 | B1 | 5/2001 | Kirsch | |
| D456,944 | S | 5/2002 | Carlquist | |
| 6,799,336 | B2 * | 10/2004 | Freeman | 4/619 |
| 6,925,660 | B1 | 8/2005 | Cartwright | |
| 2005/0283901 | A1 * | 12/2005 | Cheng | 4/523 |

* cited by examiner

*Primary Examiner*—Khoa D Huynh

(57) ABSTRACT

The shampoo basin cushioning piece cushions the neck along notch in the shampoo basin, and also securely fastens along the top perimeter of the shampoo basin. The ability of the cushioning device to securely attach along the perimeter of the shampoo basin enables the cushioning device to avoid movement and remain steady when the neck of an end user is placed upon it. The cushioning piece seeks to eliminate the movement and associated neck soreness associated with moving cushions that are designed for the neck notch of a shampoo basin. A sink or porcelain base converter that when placed over the sink or porcelain base will convert it into a shampoo basin.

1 Claim, 4 Drawing Sheets

CUSHION INSERT AND SILICON BOWL ASSEMBLY FOR SHAMPOO BOWL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of shampoo basins, more specifically, a cushioning device that securely attaches along the top perimeter of the shampoo basin so as to provide stability from movement associated with the neck being placed on traditional cushioning devices.

A further embodiment of the present invention is to provide a converter piece that when placed over a traditional sink or porcelain base will convert into a shampoo basin.

B. Discussion of the Prior Art

The Cartwright patent (U.S. Pat. No. 6,925,660) discloses a gel-filled cushioning device for use with a shampoo bowl including a front wall having an inner surface and an outer surface, and a U-shaped, neck receiving notch in the front wall. However, the cushioning device disclosed under the Cartwright Patent is directed to the notch of the shampoo basin, as opposed to a cushioning device that is mounted along the upper perimeter of the basin such that it will not easily move when a neck of the end user rests upon it. Furthermore, an alternative embodiment enables the end user to convert a traditional sink or porcelain basin into a shampoo bowl, which is not a feature disclosed under the Cartwright Patent.

The Flora patent (U.S. Pat. No. 5,978,980) discloses a neck cushioning device adapted for use with a shampoo basin having a neck-receiving notch and includes a cushioning pad formed of a gel-based material. Again, the cushioning device disclosed under the Flora Patent is directed to the notch of the shampoo basin, as opposed to a cushioning device that is mounted along the upper perimeter of the basin such that it will not easily move when a neck of the end user rests upon it.

The Kirsch patent (U.S. Pat. No. 6,230,338) discloses an arrangement for the washing or other treatment of hair of a person which comprises a sink having a rim with an indentation, as is conventional. The rim indentation receives and supports the neck of the person. A gel-type flexibly, resilient pad is carried on the rim within the indentation. Again, the cushioning device disclosed under the Kirsch Patent is directed to the notch of the shampoo basin, and not the upper perimeter of the shampoo bowl.

The Morgan patent (U.S. Pat. No. 4,763,364) discloses a neck cushioning device for engagement with hair shampoo bowls. Again, the cushioning device disclosed under the Kirsch Patent is directed to the notch of the shampoo basin, and not the upper perimeter of the shampoo bowl, which provides additional security of the cushioning device so as to eliminate unwanted movement and resulting soreness associated with the placement of the neck against the cushioning device.

The Hakim patent (U.S. Pat. No. 5,377,365) discloses a neck support for a beauty salon hair washing sinks comprising a pillow formed of an elastomeric foam with a waterproof envelope thereof. Again, the cushioning device disclosed under the Kirsch Patent is directed to the notch of the shampoo basin, and not the upper perimeter of the shampoo bowl, thereby providing enhanced security of the cushioning device.

The Carlquist patent (U.S. Pat. No. Des. 456,944) illustrates a shampoo sink cushion, which does not securely fasten about the perimeter of a traditional shampoo basin.

The Bower et al. patent (U.S. Pat. No. 5,526,539) discloses a portable washing cart with a sink where the material of the sink to be deformable into a specific configuration, whereby such configuration is retained by a material comprising: soft plastics, lead alloys, or other conventionally known ductile materials. However, the washing cart disclosed under the Bower Patent requires the use of an entire cleaning station, as opposed to a single shampoo basin. Furthermore, the washing cart is not directed to the use of placement of a cushioning device over the notch in the shampoo basin in which a cushioning device maybe designed to securely attach about the upper perimeter of the shampoo basin.

The Hajek patent (U.S. Pat. No. 4,419,774) discloses a completely biodegradable disposable plastic basin containing a circular bottom with a ringed wall upstanding around it. However, the device disclosed under the Hajek Patent is adapted to fit over an existing shampoo basin for a sanitary purpose, as opposed to providing enhanced comfort for an existing shampoo basin. Furthermore, the device disclosed does not include discussion of an alternative embodiment that can convert a traditional sink or porcelain base into a shampoo basin.

In light of the above discussed prior art there is a need for a converter that can transform a traditional sink or porcelain base into a shampoo basin.

BRIEF SUMMARY OF THE INVENTION

The preferred embodiment of the present invention is a shampoo basin cushioning device that cushions the neck along the notch in the shampoo basin, but also securely fastens along the top perimeter of the shampoo basin. The ability of the cushioning device to securely attach along the perimeter of the shampoo basin enables the cushioning device to avoid movement and remain steady when the neck of an end user is placed upon it. This embodiment seeks to eliminate the movement and associated neck soreness associated with moving cushions that are designed for the neck notch of a shampoo basin. A second embodiment is a sink or porcelain base converter that when placed over the sink or porcelain base will convert it into a shampoo basin.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
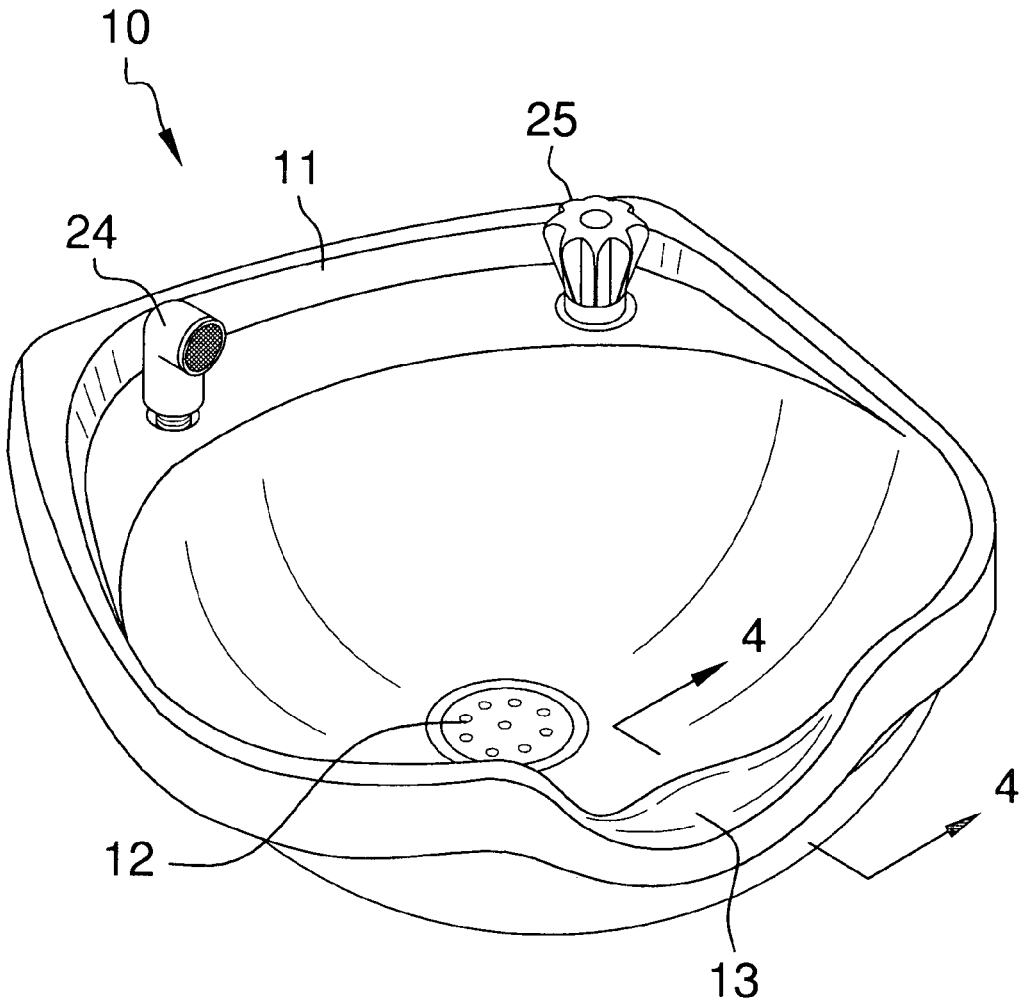
FIG. 1 illustrates an isometric view of the sink converter embodiment.
Figure 2:
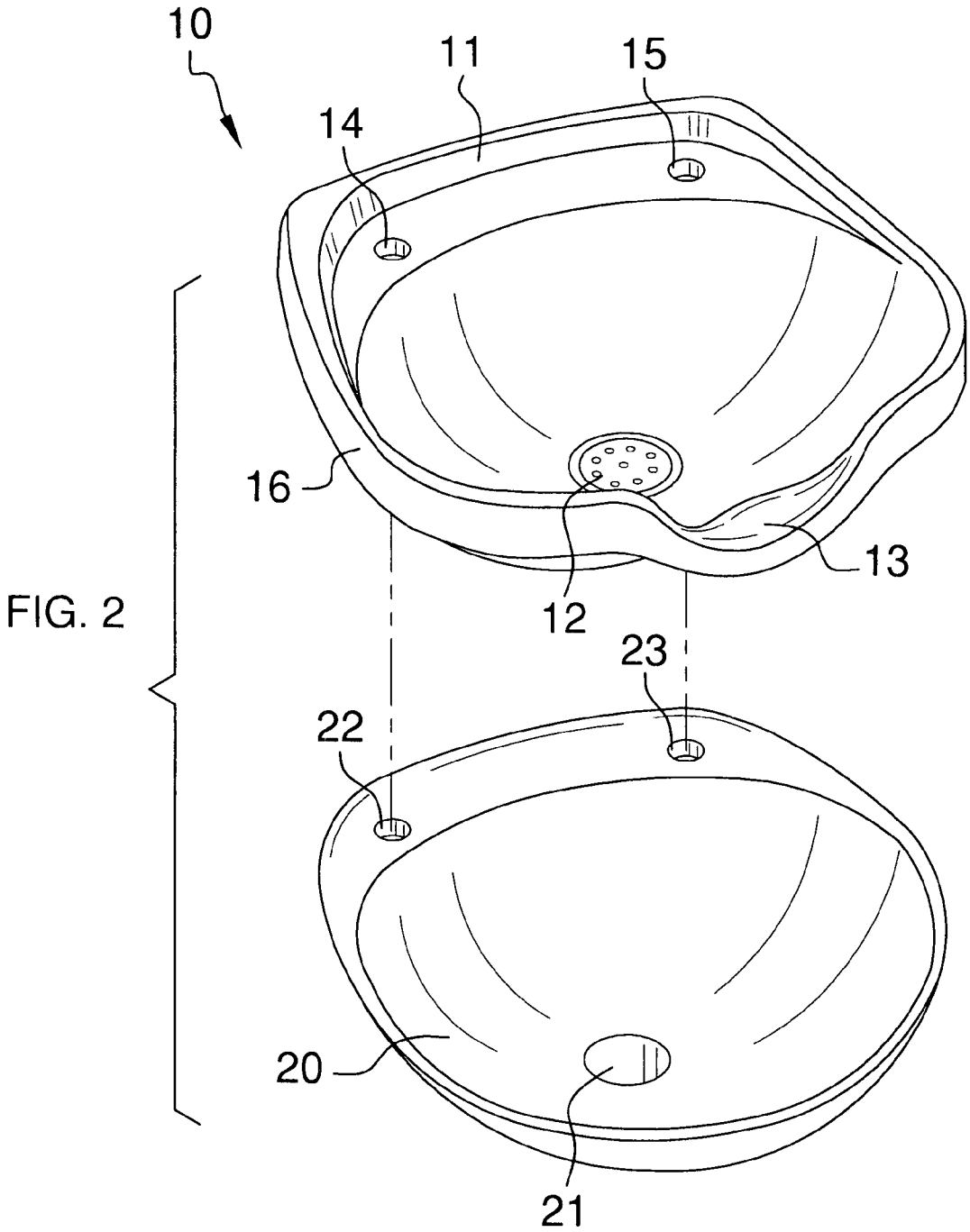
FIG. 2 illustrates an exploded view of the sink converter above an existing sink or porcelain base.
Figure 3:
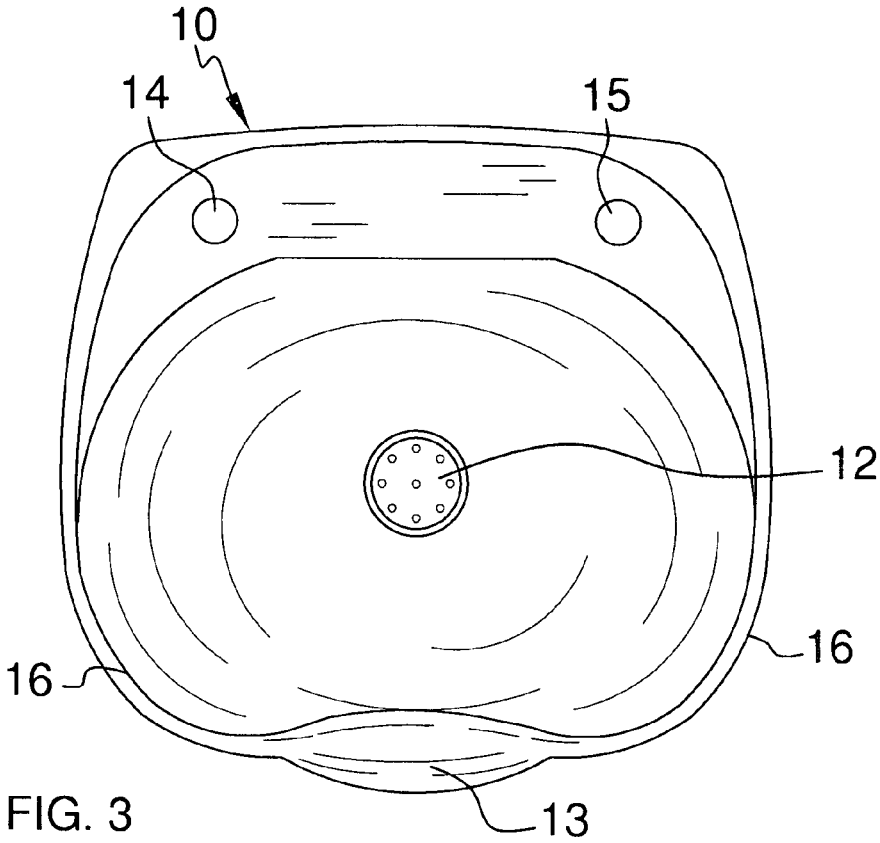
FIG. 3 illustrates a top view of the sink converter embodiment by itself.

Detailed reference will now be made to a sink converter embodiment 10 (hereinafter converter), examples of which are illustrated in FIGS. 1-4. The converter 10 consists of an upper base member 11 that reflects the shape of a shampoo bowl. The upper base member 11 includes a drain cover 12, a neck notch 13, a hose hole 14, a faucet handle hole 15, and a rim 16 for retaining water within the bowl of the upper base member 11.

The upper base member 11 is installed over a traditional sink 20. The drain cover 12 is included into the design of the upper base member 11 in order to prevent hair from passing through the upper base member 11 and entering a drain hole 21 of the sink 20.

Figure 4:
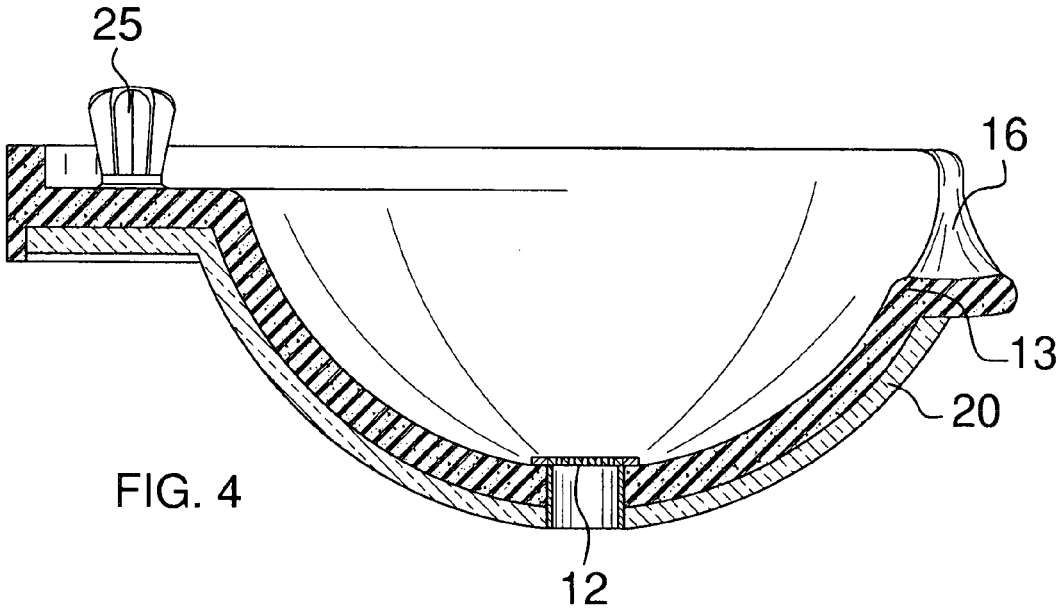
FIG. 4 illustrates a detailed view of the sink converter embodiment along line 4-4.

It shall be asserted that the primary benefit of the upper base member 11 is two fold. First, is to convert a traditional sink 20 into a shampoo basin that is typically seen in a beauty salon. Second, the upper base member 11 is made of a soft silicon material such that when the converter 10 is in use, the neck of the person whose hair is being washed will not be sore from resting upon a hard surface, like porcelain or metal. Furthermore, the design of the upper base member 11 is such that it will not move when the neck of a person is placed upon the neck notch 13, which can occur with some of the cushioning devices previously discussed with the prior art. As shown in FIG. 4, the back portion of the base member 11 of the sink converter 10 further includes a downwardly extending lip which engages the back section of the shampoo sink 20. In the assembled condition as illustrated in FIG. 4, the sink converter 10 completely covers the conventional shampoo sink 20 with the converter bowl portion resting on top of the sink bowl, the front section of the conventional shampoo sink 20 acts as a base that supports the neck notch 13, the converter back portion overlaps the upper surface of the back section of the conventional shampoo sink 20 and the downwardly extending lip engages the side surface of the back section of the conventional shampoo sink 20.

Figure 5:
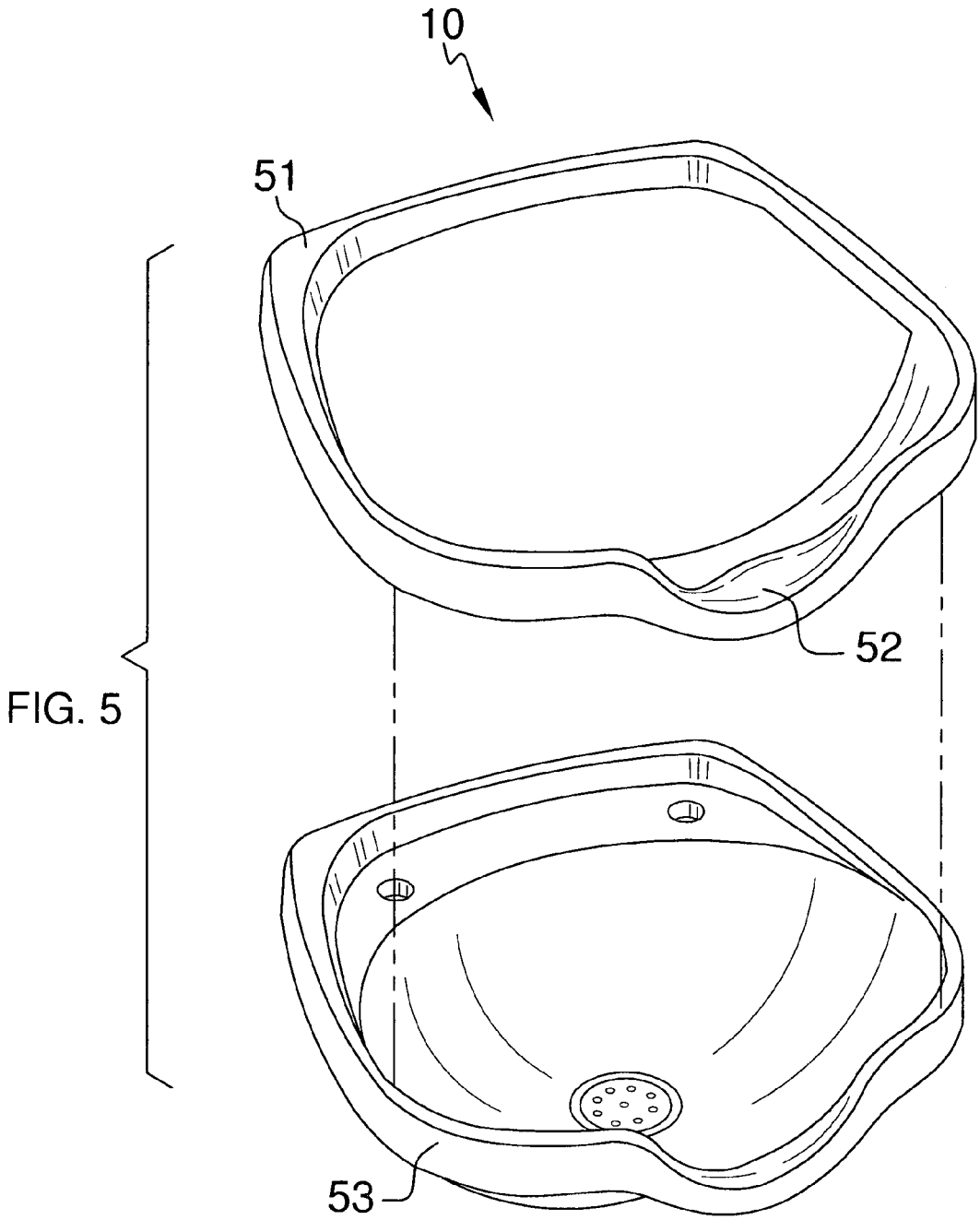
FIG. 5 illustrates an exploded view of the cushioning device embodiment.

Detailed reference will now be made to a cushioning device embodiment 50 (hereinafter cushioning device), examples of which are illustrated in FIG. 5. The cushioning device 50 consists of a cushioning piece 51 that is made of a soft silicon material. The cushioning piece 51 has a neck notch 52 for placement of the neck during use. The cushioning piece 51 is designed to be installed along the top perimeter of a traditional shampoo basin 53.

The installation of the cushioning piece 51 of the cushioning embodiment 50 is to yield a secure attachment to the shampoo basin 53, such that the cushioning piece 51 shall not move during the placement of a neck when the shampoo basin 53 is in use. It shall be asserted that the benefit of the installation of the cushioning piece 51 is to prevent soreness or pain of the neck associated with a hard material located around a neck resting notch and/or from movement of a cushioning device around said notch.

The inventor claims:

1. A shampoo sinks assembly comprising:

a conventional shampoo sink (20) having a sink bowl, a front section and a back section which is adapted to be mounted to a wall, said back section having an upper surface, an opposite lower surface and a side surface, a pair of openings (22, 23) formed on the upper surface of said back section, wherein each opening accommodating a faucet handle (25) and a sprayer (24) for washing a person's hair, said sink bowl having a drain opening (21) disposed at the center bottom thereof; and a sink converter (10) having a converter bowl portion, a converter front portion and a converter back portion; said sink converter is made of a soft silicon and is designed to fit on top and overlap said conventional shampoo sink (20); said converter bowl portion having a drain cover (12) disposed in the center bottom portion thereof, said drain cover acts a strainer and is integrated into the bottom portion of said bowl portion of said sink converter to prevent unwanted hair from entering said drain opening (21) of said conventional shampoo sink (20); said sink converter also having a neck notch (13) formed on said converter front portion, wherein said neck notch is designed to overlap the edge of said front section of said conventional shampoo sink (20) in order to accommodate the neck of a person whose hair is being shampooed; said sink converter further comprising a hose hole (14), a faucet handle hole (15) and an upwardly protruding rim (16), wherein said hose hole (14) and said a faucet handle hole (15) disposed on said converter back portion, wherein said hose hole (14) is designed to align with said sprayer (24) so as to allow said sprayer to pass through said sink converter once assembled, and wherein said faucet handle hole is designed to align with said faucet handle (25) to allow said faucet handle pass through said sink converter once assembled; said upwardly protruding rim (16) is integrally formed on the upper edge of said sink converter and is extending around the entire periphery of said sink converter from one side of said neck notch, around the back converter portion, and to the other side of said neck notch, said upwardly protruding rim is designed to prevent water from splashing outside of said sink converter; said sink convert also having a downwardly extending lip formed on said converter back portion, said downwardly extending lip engages the back section of said conventional shampoo sink in the assembled condition;

wherein when in the assembled condition, the sink converter completely covers the conventional shampoo sink with said converter bowl portion resting on top of said sink bowl, said front section of said conventional shampoo sink acts as a base that supports said neck notch, said converter back portion overlaps said upper surface of said back section of the conventional shampoo sink and said downwardly extending lip engages the side surface of said back section of said conventional shampoo sink.

* * * * *